United States Patent [19]

Gebetsroither et al.

[11] 4,186,971

[45] Feb. 5, 1980

[54] DEVICE FOR COOLING CUTTING TEETH OF CUTTER HEADS OF CUTTING MACHINES

[75] Inventors: Wolfgang Gebetsroither, Wolfsberg; Alfred Zitz, Zeltweg, both of Austria

[73] Assignee: Vereinigte Osterreichische Eisen- und Stahlwerke - Alpine Montan Aktiengesellschaft, Vienna, Austria

[21] Appl. No.: 895,500

[22] Filed: Apr. 11, 1978

[30] Foreign Application Priority Data

May 6, 1977 [AT] Austria ..... 3251/77

[51] Int. Cl.[2] ..... E21C 7/08

[52] U.S. Cl. ..... 299/64; 299/12

[58] Field of Search ..... 299/12, 64, 81

[56] References Cited

U.S. PATENT DOCUMENTS

| | | | |
|---|---|---|---|
| 1,503,870 | 8/1924 | Ball et al. | 299/12 X |
| 2,743,095 | 4/1956 | Wright | 299/12 X |
| 4,076,315 | 2/1978 | Gundlach et al. | 299/12 |
| 4,084,855 | 4/1978 | Miles et al. | 299/12 X |

*Primary Examiner*—Ernest R. Purser

*Attorney, Agent, or Firm*—Cushman, Darby & Cushman

[57] ABSTRACT

In a rock cutting machine which includes a cutter arm having an inner end and an outer end carrying a toothed cutter which rotates about an axis transverse to the longitudinal dimension of the arm, an improved cooling device for the cutting teeth of the cutter comprising a nozzle device for receiving supplies of compressed air and water and constructed to create and discharge a stream of air in which particles of liquid water are dispersed or atomized, the nozzle device being carried by the cutter arm at a location spaced from the cutter toward the inner end of the arm and arranged in a position to discharge the stream toward the cutter in a spray pattern such that the stream impinges on the teeth of the cutter as the teeth pass through the pattern during rotation of the cutter.

6 Claims, 6 Drawing Figures

DEVICE FOR COOLING CUTTING TEETH OF CUTTER HEADS OF CUTTING MACHINES

Figure 1:
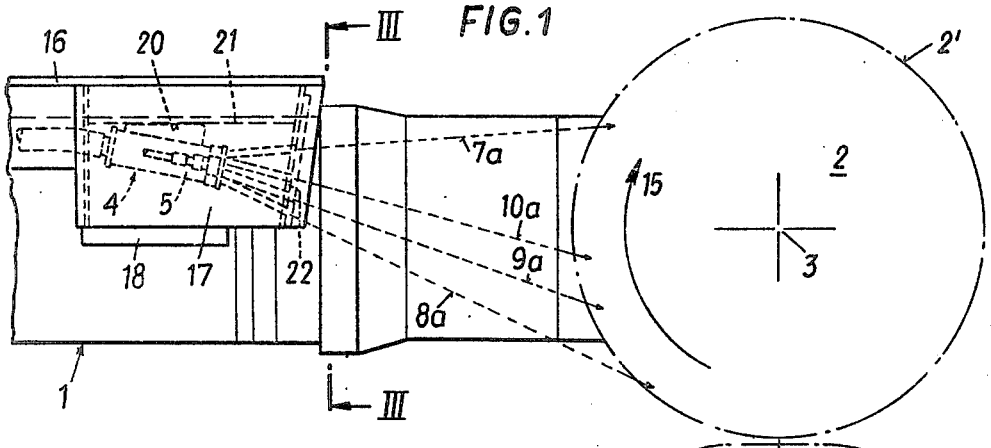

During the operation of cutting machines having rotating cutter heads, particularly during a removal of material at a high rate, the cutting teeth of the cutter heads must be cooled. They were previously cooled by jets of water directed against the cutter heads. These water jets served also to bind the dust which has been raised. This mode of cooling has the disadvantage that it results in the formation of a sump at the face, and the removal of the surplus water involved a considerable expenditure. Besides, the water consumption was considerable and imposed a heavy load on the water supply system, particularly during underground operations. It is also known to provide nozzles on the cutter head between the cutting teeth and to use compressed air to atomize the water which is discharged by said nozzles. Such nozzles may be damaged and clogged because they contact the rock which is to be cut. When the cutting teeth are to be cooled by such nozzles carried by the cutter head, a nozzle must be associated with almost every cutting tooth so that a highly complicated arrangement results. Such nozzles mounted on the cutter head discharge the cooling fluid throughout the revolutions of the cutter head, even when the associated cutter teeth cut in the rock and cannot be sprayed upon. For this reason, the arrangement has a relatively large water consumption and the cooling action is not satisfactory.

This invention relates to a device for cooling cutting teeth of a cutter head of a cutting machine with water which has been dispersed or atomized by means of air. It is an object of the invention to provide for an effective cooling of the cutting teeth while minimizing the water consumption. The invention essentially resides in that the cutter arm carries at least one nozzle behind the cutter head with respect to the direction of propulsion, said nozzle is directed to the cutter head and connected to a compressed-air source, and communicates with at least one water supply passage. This nozzle discharges an air stream, which is directed against the cutting teeth and contains water which is dispersed or atomized in the air or forms an aerosol therewith. Since the nozzles are mounted on the cutter arm so that the cutting teeth move relative to the jets discharged by the nozzles, one nozzle or a few nozzles can adequately cool the cutting teeth of the cutter head because the jet impinges on all cutting teeth during a revolution. Damage to these nozzles and a clogging thereof are avoided because they are not close to the rock to be cut and are not contacted by the material which has been detached. This results in an arrangement which is simpler and more reliable in operation. Because the jets discharged by the nozzles strike on all cutting teeth in succession when the cutting teeth are clear of the rock to be cut, the cooling capacity of these nozzles is fully utilized so that the water consumption can be minimized. With such nozzles spaced apart from the cutter head, a special advantage will be afforded by the supply of water to the cutting teeth in a dispersed or atomized form or as an aerosol. The cutting teeth to be cooled are at a temperature which exceeds the boiling point of the water, e.g., at about 130° C. When cutting teeth at such temperatures are cooled with water which impinges on the cutting teeth in the form of drops, the so-called Leidenfrost phenomenon occurs, which resides in that the drops do not evaporate on the hot surface but are surrounded by a vapor envelope, which prevents a direct action of the water on the surface which is to be cooled. On the other hand, when the surface to be cooled is supplied with water which is atomized or forms an aerosol of water dissolved in air, the Leidenfrost phenomenon will not occur and the heat of evaporation of the water will be fully utilized to cool the cutting teeth. In a known arrangement in which the nozzles are mounted on the cutter head and discharge jets of water directly onto the cutting teeth, the occurrence of the Leidenfrost phenomenon will be prevented by turbulence so that in such case a cooling with atomized or dispersed water will be less effective than a cooling with a water jet. In all cases, the use of the invention will prevent the formation of a sump near the cutter head because the water consumption is reduced.

In accordance with the invention the nozzles consist suitably of tubes which are provided at their end with constricted nozzle tips and are also provided with peripherally spaced apart water supply bores through which water under superatmospheric pressure enters the air stream.

In a preferred embodiment of the invention, the axis of the nozzle is or the axes of the nozzles are directed to that side of the cutter head on which the cutting teeth emerge from the rock. The cutting teeth of a cutter head cut in the rock within a smaller portion of the periphery of the cutter head and are exposed in an arc of about 240°. Because the air stream which contains the dispersed or atomized water or the aerosol stream is preferably directed to that side of the cutter head on which the cutting teeth emerge from the rock, the cooling is initiated at that point and acts throughout the arc in which the cutting teeth are exposed and until they re-enter the rock. This results in a particularly effective cooling. Where a plurality of nozzles are provided, the axes of a majority of these nozzles are suitably directed to that side of the cutter head on which the cutting teeth emerge from the rock.

This is suitably accomplished in accordance with the invention in that the nozzles associated with a cutter head have diverging axes and are connected to a common pressure vessel, which communicates with a compressed-air conduit. Where two cutter heads are mounted on opposite sides of the cutter arm for rotation about a horizontal axis which is transverse to the cutter arm, the air nozzles are suitably arranged in mirror symmetry and secured to the cutter arm on opposite sides thereof. As a result, the water-containing jets impinge on the tips of the cutting teeth in a considerable part of their flight circle. The size and location of this part of the flight circle can be empirically determined and controlled by an adjustment of the directions of the nozzles.

Figure 2:
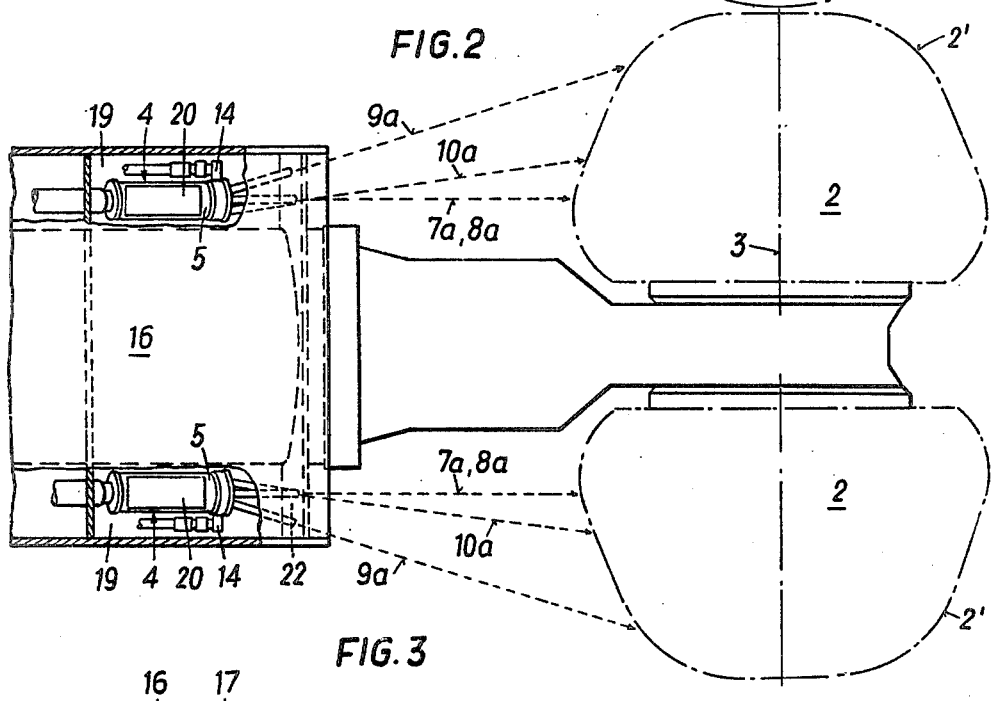
Figure 3:
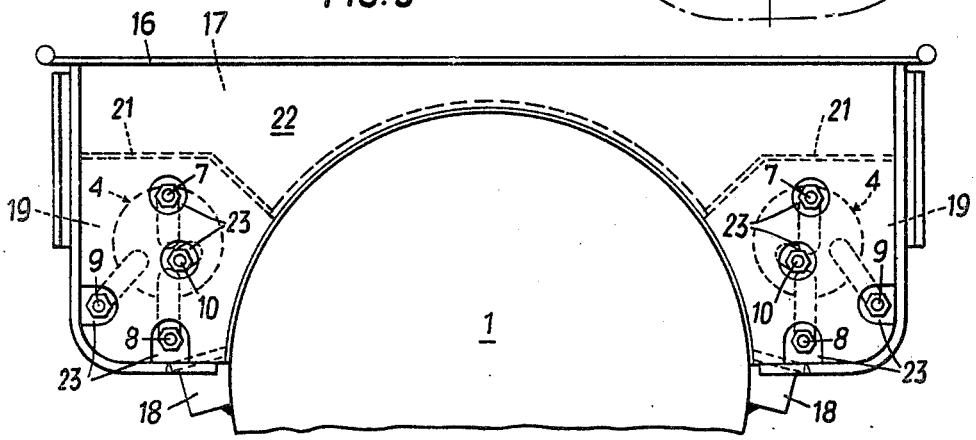
Figure 4:
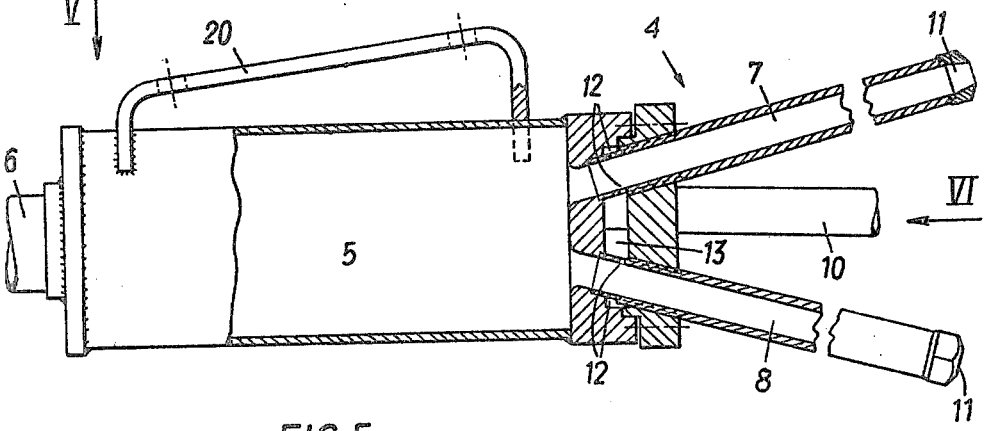
Figure 5:
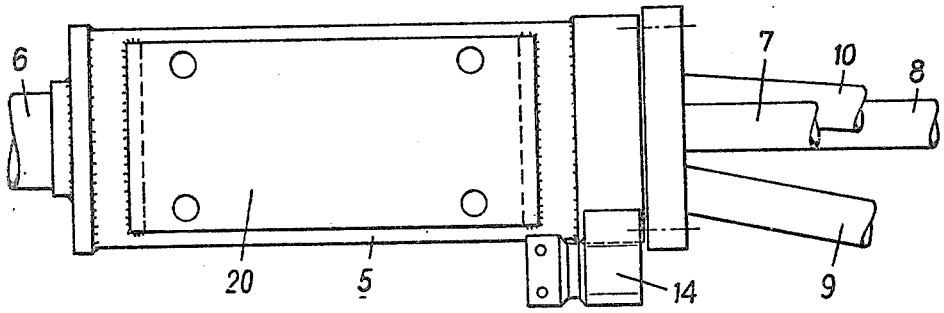
Figure 6:
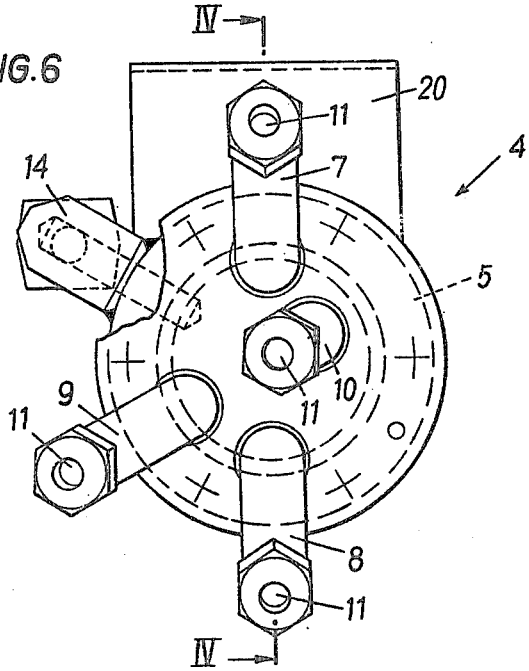

An embodiment of the invention is shown diagrammatically and by way of example on the drawing, in which the forward portion of the cutter arm of a cutting machine, with the cutter heads and the cooling devices, is shown in FIG. 1 in a side elevation, in FIG. 2 in a top plan view and in FIG. 3 in a sectional view taken on line III–III in FIG. 1. The cutter arm is indicated by a circle in FIG. 3. The nozzle system is shown on a larger scale in FIG. 4 in a sectional view taken on line IV–IV of FIG. 6, in FIG. 5 in an elevation in the direction of arrow V in FIG. 4, and in FIG. 6 in an elevation taken in the direction of arrow VI in FIG. 4.

Two cutter heads 2 are mounted at the end of a cutter arm 1 for rotation about a horizontal axis 3. The flight circle 2' described by the tips of the cutting teeth is indicated in phantom. Cooling devices 4 are secured to the cutter arm on both sides thereof and are shown on a larger scale in FIGS. 4 to 6. Each of these cooling devices 4 comprises a pressure vessel 5, which is provided with a nipple 6 for connection to a compressed-air source and is supplied with air under a pressure of, e.g., 4 to 7 bars. Nozzles 7,8,9 and 10 are connected to the pressure vessel 5 and are provided at their forward end with nozzle tips 11. The nozzles 7,8,9,10 are also provided with radial bores 12, which are peripherally spaced apart and connect the interior of the nozzles to a water-containing space 13. Water under a pressure of about 1 to 2 bars is supplied to the space 13 through a fitting 14. The pressure in the vessel 5 is so high that the water-containing air emerges from the nozzle tips 11 at a velocity of about 100 m/sec and is still at a velocity of about 30 m/sec when impinging on the cutting teeth of the cutter head 2. Water and air are discharged by the nozzles in the form of an aerosol or at least in the form of air streams containing dispersed or atomized water.

As is apparent from FIG. 2, the cooling devices 4 are arranged in mirror symmetry on both sides of the cutter arm 1.

The axes of the nozzles 7,8,9 and 10 diverge. The axes of the jets discharged by said nozzles 7,8,9 and 10 are shown in FIGS. 1 and 2, and designated *7a,8a,9a* and *10a*, respectively. The direction of rotation of the cutter head is indicated in FIG. 1 by an arrow 15. It is apparent from FIG. 1 that the jets having axes designated *8a,-9a,10a* reach the flight circle 2' described by the tips of the cutting teeth in that region in which the cutting teeth emerge from the rock.

The cutter arm 1 is provided with brackets 18, which carry a walk-on platform 16, which has a box-section body 17 and covers the cutter arm 1. The box-section body 17 of the platform 16 defines interior cavities 19, in which the cooling devices 4 are accommodated and protected. A U-shaped member 20 is secured to the pressure vessel 5 and bolted to partitions 21 of the box-section body 17. The latter is covered at its forward end by a plate 22, which has apertures 23 through which the jets *7a, 8a, 9a* and *10a* can be discharged. The cooling devices 4 are thus protected during the cutting operation against damage which might be dure to rock falling down and other causes.

We claim:

1. In a rock cutting machine which includes a cutter arm having an inner end and an outer end carrying a toothed cutter which rotates about an axis transverse to the longitudinal dimension of the arm, an improved cooling device for the cutting teeth of the cutter comprising nozzle means for receiving supplies of compressed air and water and constructed to create and discharge a stream of air in which particles of liquid water are dispersed or atomized, said nozzle means being carried by said cutter arm at a location spaced from the cutter toward the inner end of the arm and arranged in a position to discharge the stream toward the cutter in a spray pattern such that the stream impinges on the teeth of the cutter as the teeth pass through the pattern during rotation of the cutter.

2. A machine as in claim 1 wherein the nozzle means includes at least one nozzle having a discharge axis directed to that side of the rotatable cutter on which the teeth emerge from the rock during a cutting operation.

3. A machine as in claim 1 wherein the nozzle means includes a plurality of nozzles the majority of which have discharge axes directed to that side of the cutter on which the teeth emerge from the rock during a cutting operation.

4. A machine as in claim 1 wherein the nozzle means includes a plurality of nozzles each of which comprises a tubular body having an outer end fitted with a constricted nozzle discharge tip, the tubular body having a bore connected with an air pressure source and having peripherally spaced apart apertures communicating with the bore and connected to a water source.

5. A machine as in claim 1 wherein the nozzle means includes a plurality of nozzles having discharge axes which diverge relative to each other, the nozzles having bores connected to a common air pressure vessel having a connection adapted to receive a supply of compressed air.

6. A machine as in claim 1 wherein the cutter includes two cutter heads mounted on opposite sides of the arm for rotation about a horizontal axis which is transverse to the longitudinal dimension of the arm, and wherein the nozzle means includes a plurality of nozzles arranged in mirror symmetry on opposite sides of the arm.

* * * * *